US005649399A

United States Patent [19]

Kepets

[11] Patent Number: 5,649,399

[45] Date of Patent: Jul. 22, 1997

[54] COVER PANEL SYSTEM

[75] Inventor: Arie Kepets, Flushing, N.Y.

[73] Assignee: Thermacon Industries, Inc., New York, N.Y.

[21] Appl. No.: 282,949

[22] Filed: Jul. 29, 1994

[51] Int. Cl.[6] ..... E04B 1/68

[52] U.S. Cl. ..... 52/396.06; 52/169.7; 52/471; 52/588.1

[58] Field of Search ..... 52/169.7, 396.06, 52/245, 20, 169.6, 91.3, 270, 262, 588.1, 460, 469, 470, 471; 220/308, 357, 358; 4/498, 500, 501, 502, 503

[56] References Cited

U.S. PATENT DOCUMENTS

| | | | |
|---|---|---|---|
| 3,282,613 | 11/1966 | Axelsonn | 52/396.06 |
| 3,283,462 | 11/1966 | Gregoire | 52/396.06 X |
| 3,885,362 | 5/1975 | Pollock | 52/270 |
| 4,614,067 | 9/1986 | Matsubara | 52/396.06 X |
| 4,784,516 | 11/1988 | Cox | 52/396.06 X |
| 4,858,398 | 8/1989 | Ricchini | 52/91.3 |
| 4,909,296 | 3/1990 | Sellke et al. | 160/67 |
| 4,930,561 | 6/1990 | Clay | 160/40 |
| 5,090,713 | 2/1992 | Johnson | 52/169.7 X |

FOREIGN PATENT DOCUMENTS

| | | | |
|---|---|---|---|
| 3202385 | 8/1983 | Germany | 52/588.1 |

*Primary Examiner*—Michael Safavi

*Attorney, Agent, or Firm*—Seidel, Gonda, Lavorgna & Monaco, PC

[57] ABSTRACT

A cover panel system for a vessel having an opening includes a plurality of individual panels arranged adjacent each other and spanning at least a portion of the opening. Each panel is generally polygonal in shape and has a depending side wall depending from each polygon side. Each panel is supported along at least one depending side wall across the portion of the opening. The side walls of adjacent panels facing each other and define a gap—between them. A compressible seal is located in the gap between the side portions of adjacent panels for tightly sealing the facing side portions of adjacent panels. Adjacent panels are removably interlocked together.

12 Claims, 7 Drawing Sheets

COVER PANEL SYSTEM

FIELD OF THE INVENTION

The present invention relates to fixed, air-tight, vapor-tight, and water-tight flat cover systems for open vessels and flow channels such as separators, clarifiers, sludge tanks, and other open tanks.

BACKGROUND OF THE INVENTION

Federal and state statutes and regulations limit the amount of gases and emissions that can be released into the environment from all sources. In particular, the National Emissions Standard for Hazardous Air Pollutants (NESHAP), 40 C.F.R. Section 61, et seq., Subpart FF, requires that all liquid storage tanks (such as those commonly found at petrochemical facilities and refineries) have fixed roofs (or covers) and a closed ventilation system. In addition to storage tanks, hazardous air pollutants are also emitted from other facilities such as waste water and sewage treatment plants.

Until now, there has been no easy way to cover tanks or other vessels or channels for hazardous liquids. Many prior systems used individual metal sheets or panels simply arranged in a side-by-side fashion. This type of system has several drawbacks, however, which make it unsuitable for use in connection with Clean Air Act, NESHAP, and state clean air regulation requirements. Most significantly, it is impossible to make the space between adjacent panels sufficiently airtight to meet Clean Air Act, NESHAP, and state standards.

There is a need for a cover panel system which meets or exceeds all applicable Clean Air Act, NESHAP, state clean air, and other emissions standards and which is easy to install, remove and reinstall, does not require special tools, and provides easy access for maintenance. The cover panel system should also be capable of being installed on both existing and new structures.

The present invention fulfills those needs.

SUMMARY OF THE INVENTION

The present invention is directed to a cover panel system for a vessel having an opening. The cover panel system comprises a plurality of individual panels arranged adjacent each other and spanning at least a portion of the opening. Each panel is generally polygonal in shape and has a depending side wall depending from each polygon side. Each panel is supported along at least one depending side wall across the portion of the opening. The side walls of adjacent panels face each other and define a gap between them. A compressible seal is located in the gap between the side portions of adjacent panels for tightly sealing the facing side portions of adjacent panels. Means are provided for removably interlocking adjacent panels together.

DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE INVENTION

Figure 1:
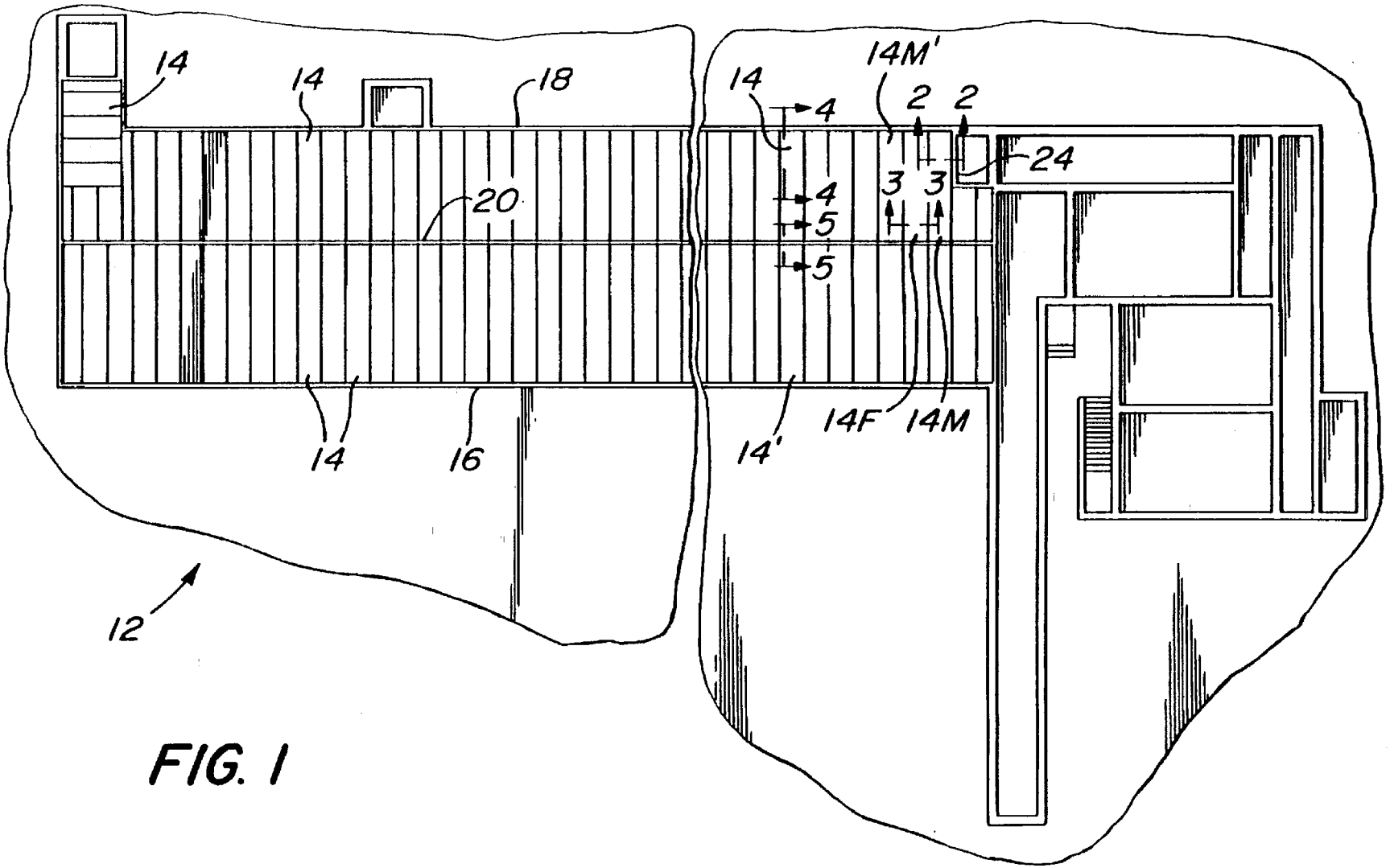
FIG. 1 is a top plan view of an installation showing a cover panel system according to the invention.

In the drawings, in which like numerals indicate like elements, there is shown in FIG. 1 an installation 12 incorporating a cover panel system according to the invention. In FIG. 1, the installation 12 represents a flow channel such as would be found in a typical waste water treatment plant. A plurality of individual panels 14 are shown spanning a flow channel defined by sides 16 and 18. In the installation represented in FIG. 1, the flow channel is shown sufficiently wide as to require two parallel runs of panels 14 to span its width. In this case, there is a center support 20 provided longitudinally along the channel to support one end of each run of panels. However, it should be understood that the invention is not limited to any number of runs of panels, or indeed any number of panels, and other configurations such as a single run of panels or more than two runs of panels may be employed. As those skilled in this art will appreciate, the number, configuration and placement of panels is determined by the size and shape of the opening to be covered, and the number, configuration and placement of panels for a given opening can easily be determined by those of skill in the art without undue experimentation.

Moreover, the invention is not limited to flow channels or tanks, but is applicable to any open structure for containing or channeling liquids. For convenience herein, such structures will be referred to as "vessels," it being understood that, as used herein, the term "vessel" includes both structures for containing a liquid, such as but not limited to tanks, including rectangular, circular and other polygon shapes, and structures other than pipes through which liquid flows or is intended to flow.

As seen in FIG. 1, each individual panel 14 is generally rectangular in plan, although it should be understood that individual panels may if necessary depart from the shape of an exact rectangle and may have the shape of a square, a trapezoid, or other polygon as may be required to completely cover the shape of the opening to be covered. However, it is envisioned that a four-sided shape will be the most commonly used and, for convenience, only rectangular panels will be described herein.

Figure 2:
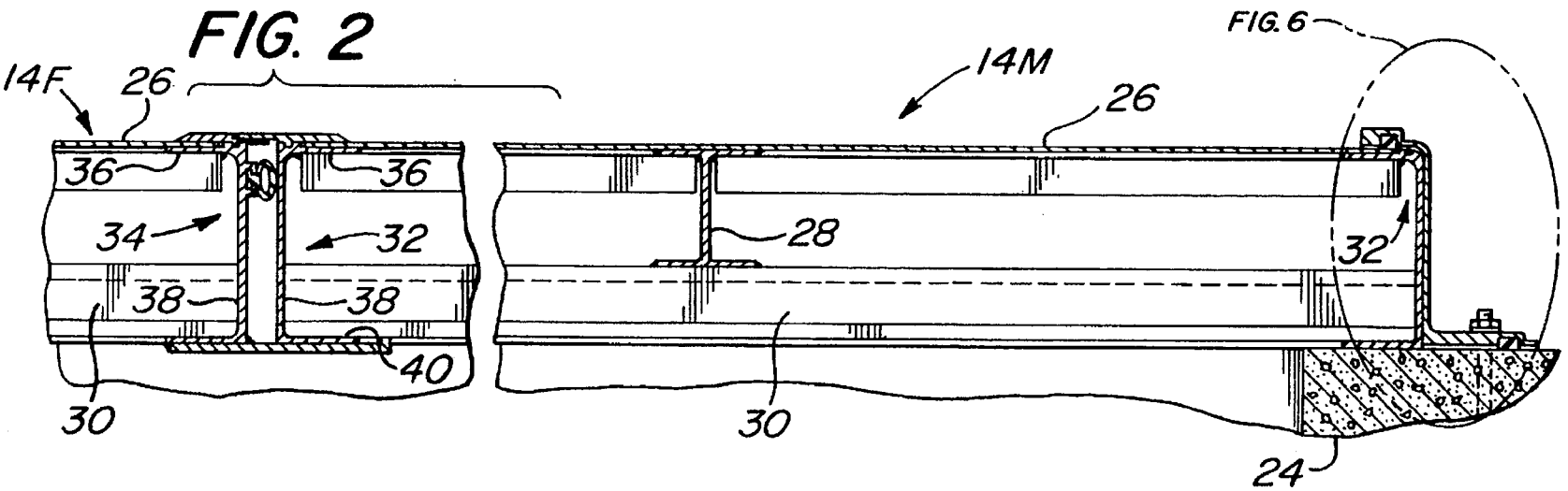
FIG. 2 is a partial sectional view taken along the lines 2—2 in FIG. 1.
Figure 3:
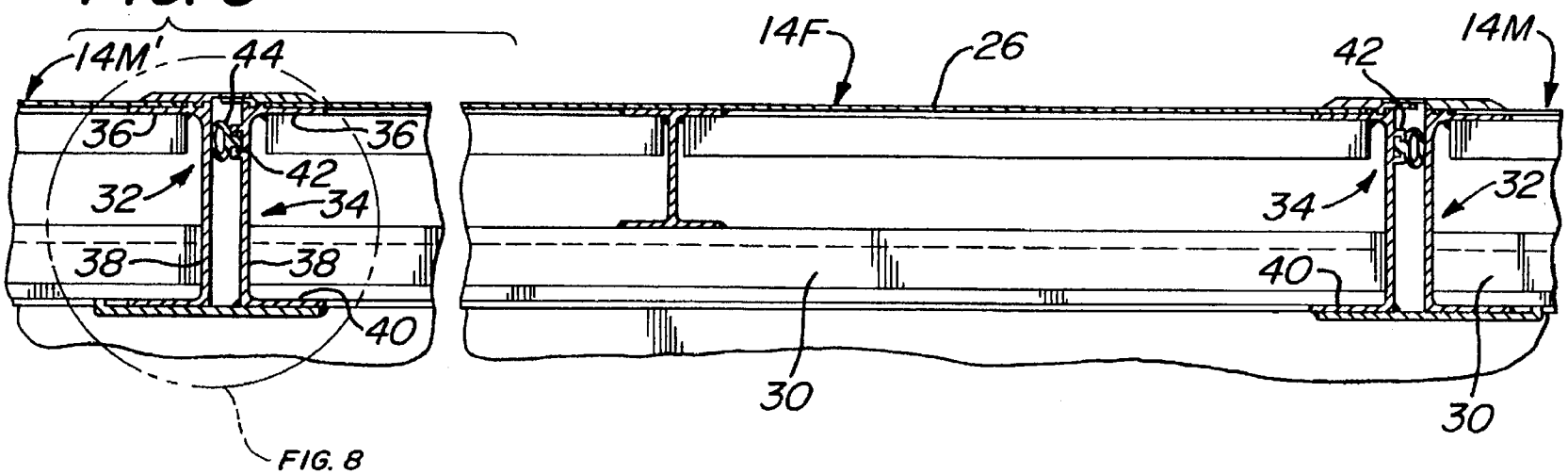
FIG. 3 is a partial sectional view taken along the lines 3—3 in FIG. 1.

FIG. 2 is a transverse cross-sectional view taken along the lines 2—2 in FIG. 1, and shows two adjacent panels 14M and 14F arranged side-by-side. One side of panel 14M is adjacent one side of panel 14F, and the opposite side of panel 14M overlies an end wall 24 of the channel being covered. FIG. 3 shows a cross-sectional view of panel 14F arranged between panel 14M and panel 14M'.

As can be seen from FIGS. 2 and 3, there are two slightly different types of individual panels 14, which may be referred to, for purely arbitrary reasons, as "male" panels, such as represented by panels 14M and 14M', and "female" panels, such as represented by panel 14F. Both types of panels comprise a metal deck plate 26, a longitudinal support member such as I-beam 28 and a plurality of transverse support members 30. I-beam 28 is included when required to satisfy mechanical loading requirements. Under lighter loads, I-beam 28 may be omitted. Deck plate 26 of the male panel is supported on either side by extrusions 32 which, in addition to supporting deck plate 26, form the sides of male panels 14M. In a similar manner, deck plate 26 of the female panels is supported by extrusions 34 which, in addition to supporting deck plate 26, also form the sides of the female panels 14F. Both extrusion 32 and extrusion 34 are generally C-shaped, and have horizontal upper portions 36 on which rest deck plates 26, vertical side walls 38 and horizontal bottom portions 40. As can be seen from the figures, extrusions 32 and 34 are quite similar, except that extrusion 34 is provided with a generally C-shaped channel on the outside of side wall 38. C-shaped channel 42 receives a compressible seal 44 therein. Seal 44 has a generally T-shaped spine 46 which enables seal 44 to be slidingly inserted into channel 42. Seal 44 also comprises a generally tubular portion 48 integral with spine 46. In the relaxed state, tubular portion 48 has a generally circular cross-section. However, when a female panel 14F and a male panel 14M are placed adjacent one another, tubular portion 48 is compressed to a generally elliptical shape, as shown in the figures. This permits a tight seal between the side wall of female panel 14F and the side wall of male panel 14M defined by extrusions 34 and 32, respectively. Consequently, any gases or vapors emitted from below the cover panels will be prevented from escaping between the sides of adjacent panels. Of course, extrusion 34 can be provided with a channel for receiving seal 44 instead of extrusion 32, or both extrusion 32 and 34 can be provided with channels for seals, without departing from the invention.

Figure 8:
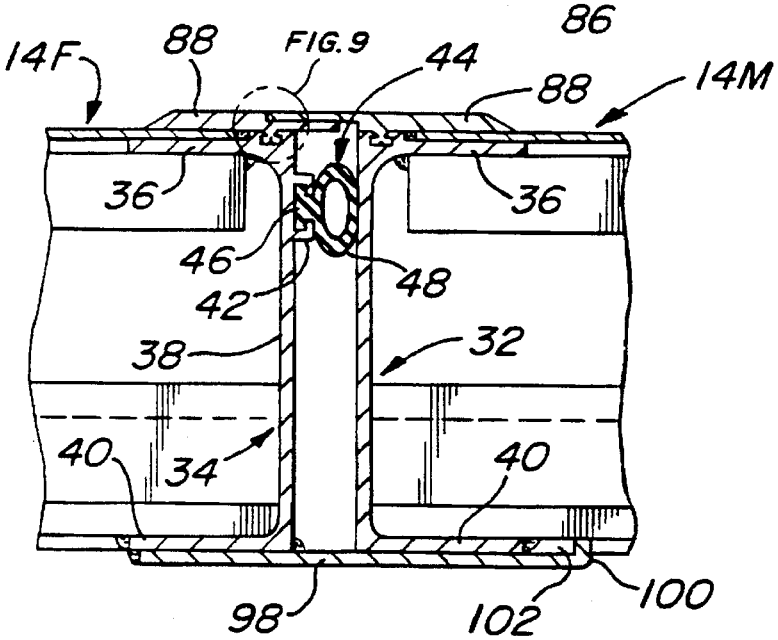
FIG. 8 is an enlarged view of the area between adjacent panels, showing a compressible between the panels.
Figure 8B:
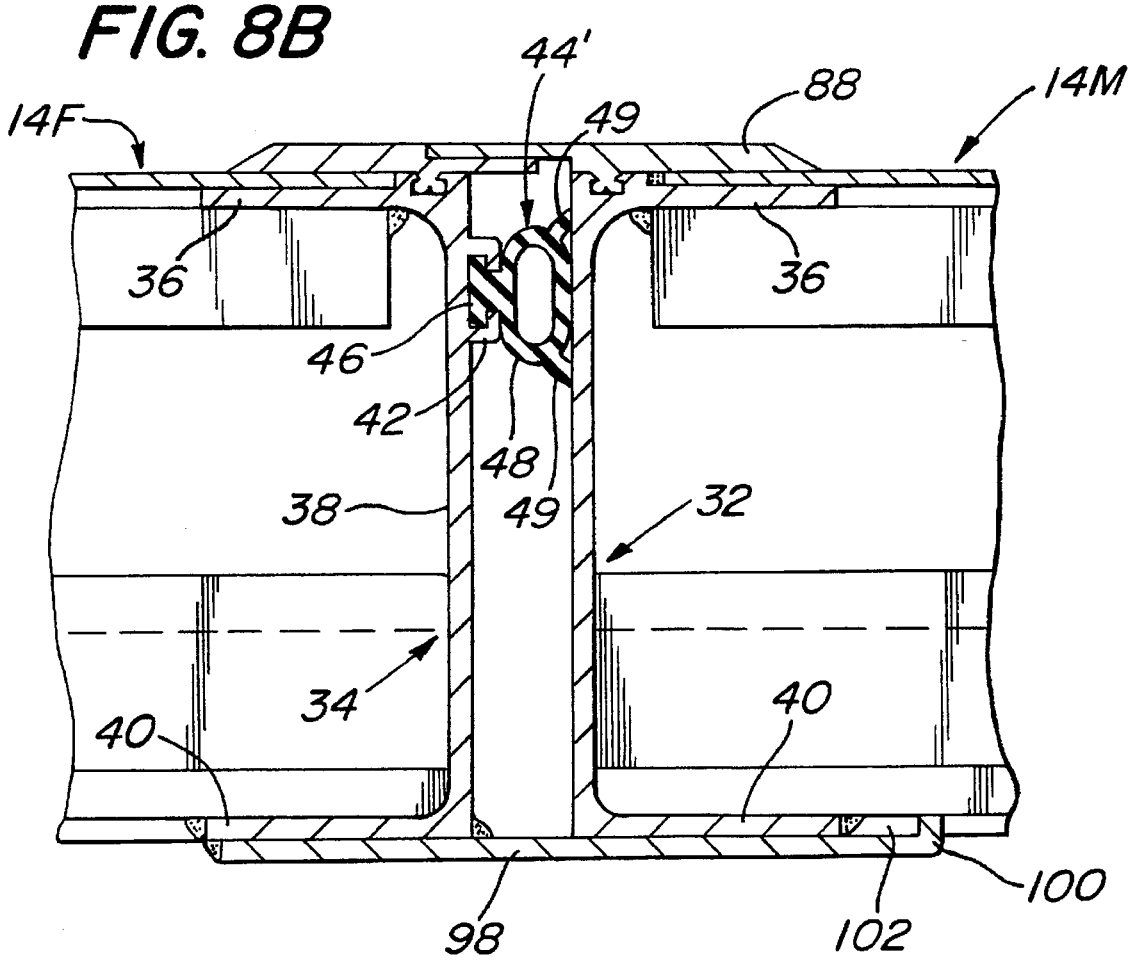
FIG. 8B is a view of the area between adjacent panels, even further enlarged, illustrating compression of the seal shown in FIG. 8A.
Figure 8A:
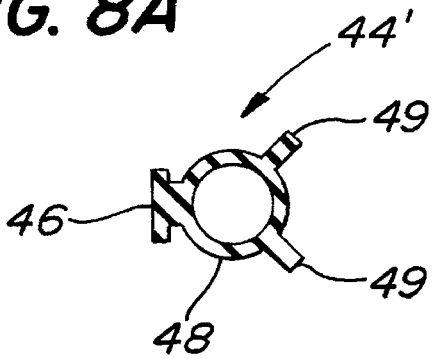
FIG. 8A shows the compressible seal in a relaxed state, prior to insertion into a panel.

A preferred form of seal 44' is illustrated in FIGS. 8A and 8B. The seal 44' differs from seal 44 in that it includes integral wiper elements 49 which extend longitudinally along the length of seal 44'. Wiper elements 49 are advantageous in that they work in conjunction with tubular portion 48 to afford a double seal between adjacent panels. This is important where legal requirements specify a double seal. Wiper elements 49 also help assure that the seal 44' will not become distorted as a result of relative movement of adjacent panels under load, such as when a worker is standing on a panel or moves from panel to panel. Wiper elements help distribute such load forces so that the seal 44' retains the shape illustrated, rather than becoming compressed all to one side or the other. Furthermore, wiper elements 49 act as an additional barrier to the tubular portion 48 of seal 44' against dirt or debris, or against mechanical damage when panels move relative to one another while in place or when panels are removed and replaced.

Figure 4:
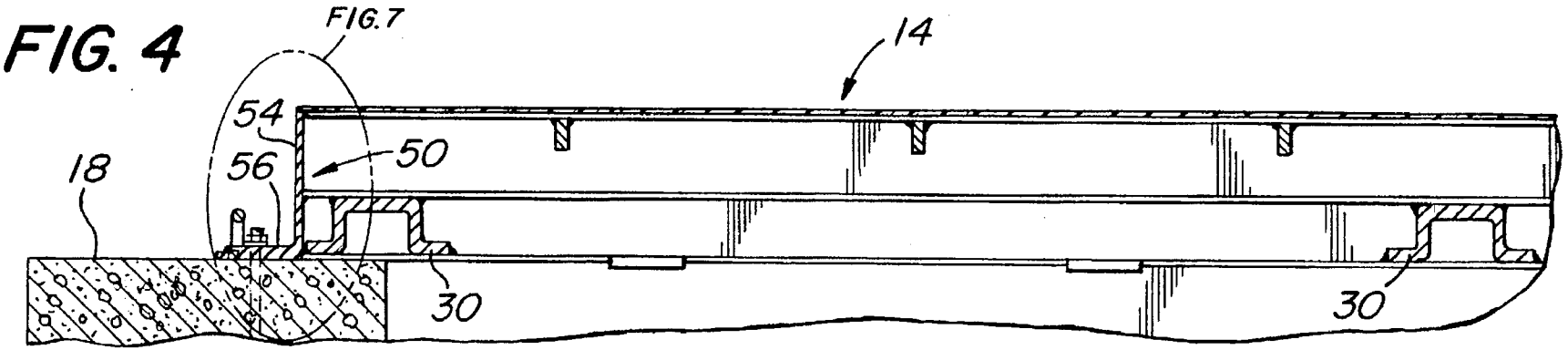
FIG. 4 is a partial sectional view taken along the lines 4—4 in FIG. 1.
Figure 5:
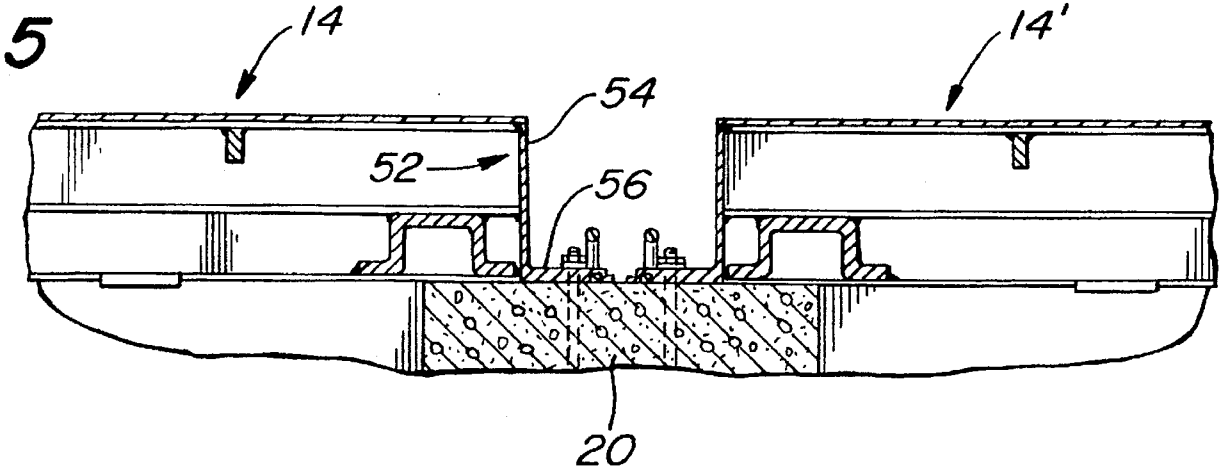
FIG. 5 is a partial sectional view taken along the lines 5—5 in FIG. 1.
Figure 6:
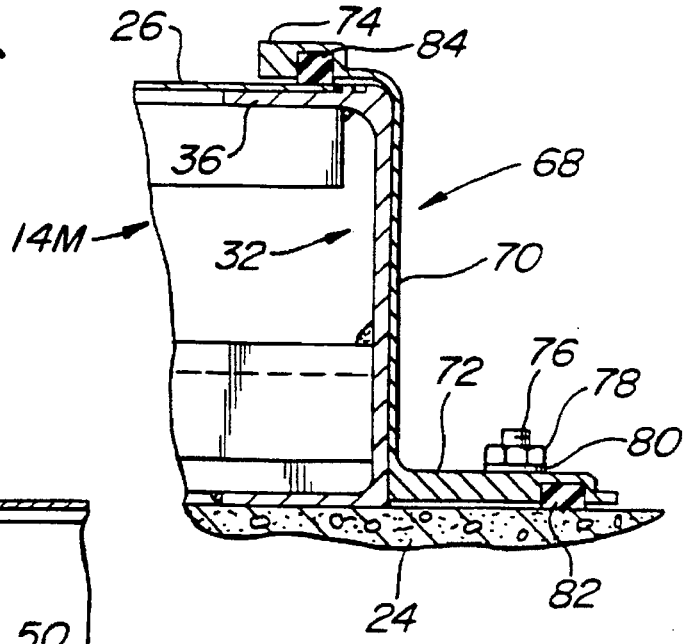
FIG. 6 is an enlarged view of one side of a panel at the end of a run of panels, showing the side of a panel may be attached to a structure.
Figure 10:
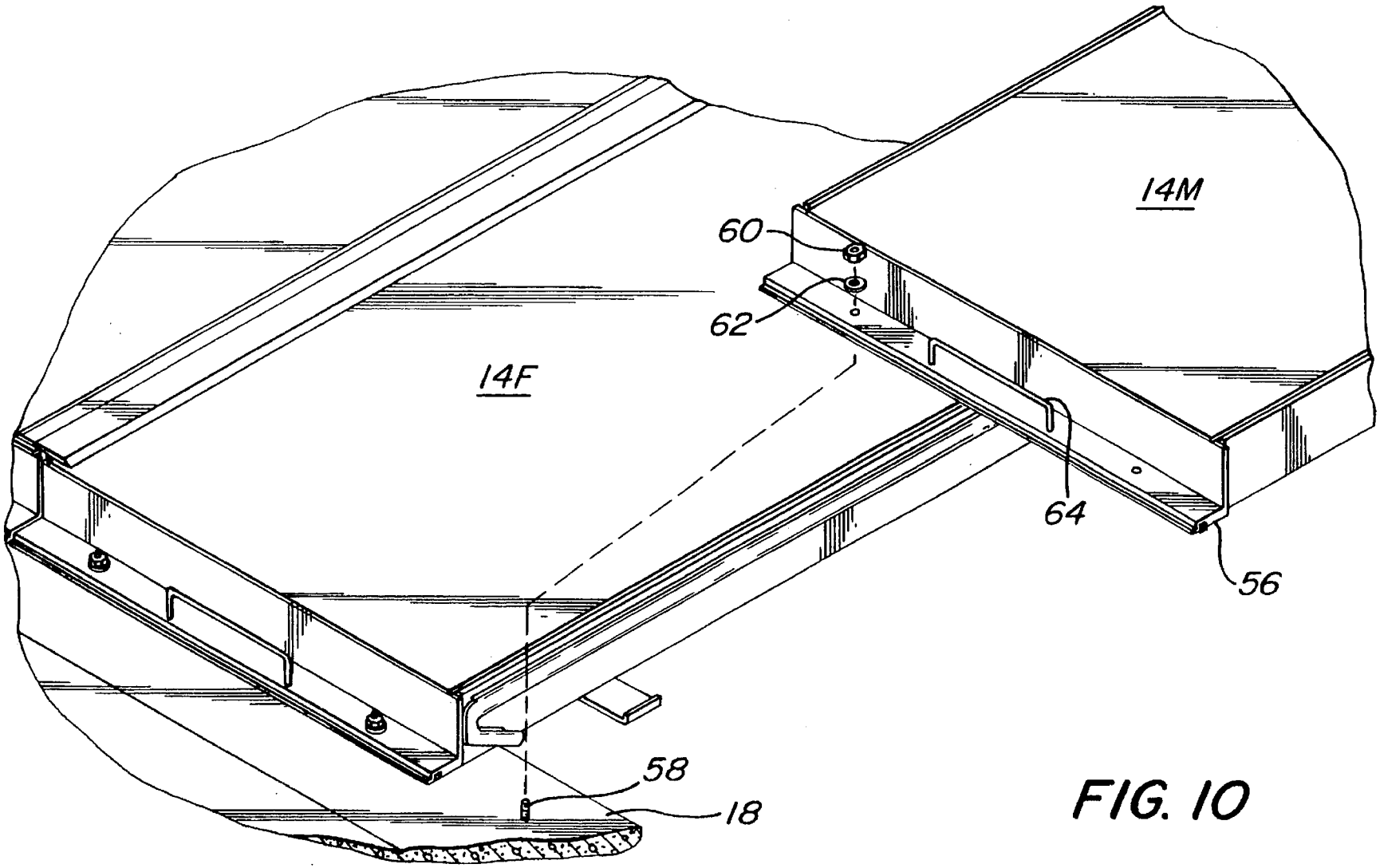
FIG. 10 is a partially exploded view showing how an individual panel may be installed or removed.

FIGS. 4, 5 and 6 show how individual panels 14 span an opening to be covered. FIGS. 4 and 5 are longitudinal sectional views of a panel 14 (which may be either male or female for purposes of FIGS. 4, 5 and 6). FIGS. 1, 4 and 5 show individual panels 14 and 14' spanning the channel defined between sides 16 and 18 and longitudinally bisected by center support 20. As seen in FIG. 4, one end 50 of panel 14 is supported by side 18 and the opposite end 52 is supported by center support 20. Each end 50 and 52 comprises an L-shaped bracket 54, attached to panel 14 in a suitable manner, such as by welding. Bracket 54 has a generally horizontal foot portion 56 which extends outward and away from ends 50 and 52. Foot 56 of bracket 54 is provided with an opening through which a suitable fastener, such as threaded rod 58, may be received so that panel 14 may be removably fastened to side 18 and support 20. Thus, individual panels 14 may be lagged down to rod 58, using a nut 60 and a lockwasher 62. (See FIGS. 6 and 10.)

Foot 56 is also provided with a handle 64, by means of which panel 14 may be lifted and carried for installation or removal.

Foot 56 is further provided with a recess in which a compressible seal 66 is retained. Compressible seal 66 cooperates with side 18 to seal in any emissions which may attempt to escape along side 18.

Figure 7:
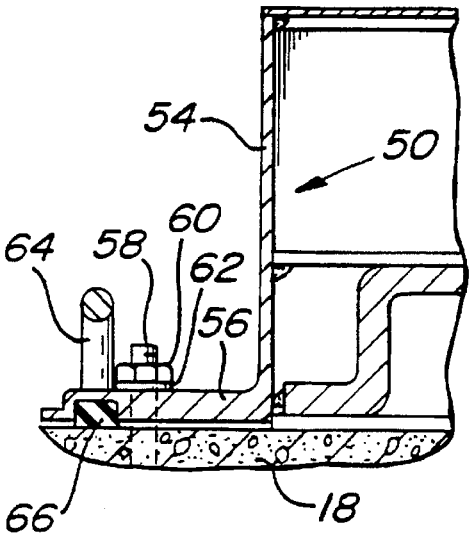
FIG. 7 is an enlarged view of one end of a panel, showing how it may be attached to a structure.
Figure 9:
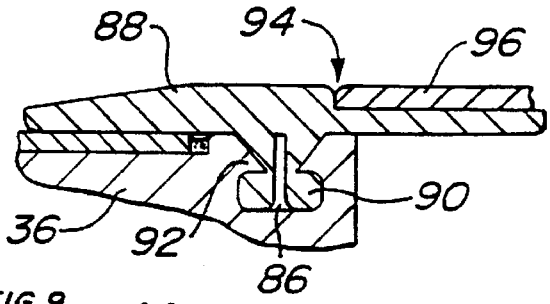
FIG. 9 is an enlarged view of a snap-in cap according to the invention to provide a smooth transition from the top surface of one panel to the top surface of an adjacent panel and to protect the sealing gasket between adjacent panels.

In similar manner, individual panels 14 are mounted along their sides to the ends of the opening, such as shown in FIGS. 4 and 7. The side of panel 14M defined by extrusion 32, as seen in FIGS. 4, 6 and 7, is the last panel in a run of adjacent panels. Panel 14M partially overlies end wall 24 of the channel and is removably fastened to end wall by a generally Z-shaped bracket 68. Z-shaped bracket 68 has a generally vertical wall 70, a generally horizontal foot portion 72, which is similar to foot portion 56 on L-shaped bracket 54, and a generally horizontal top portion 74. Foot portion 72 extends out and away from extrusion 32. Top portion 74 extends inward and over the horizontal upper portion 36 of extrusion 32 and over deck plate 26. In a manner similar to that described with respect foot portion 56 of bracket 54, foot portion 72 of bracket 68 is provided with an opening for receiving a threaded rod 76 to which panel 14M may be removably attached by means of nut 78 and lockwasher 80. In addition, foot portion 72 is provided with a groove which receives a compressible seal 82 to seal panel 14 with respect to end wall 24, in a manner similar to that already described for compressible seal 66. Top portion 74 of bracket 68, which extends over deck plate 26, is also provided with a groove for retaining a resilient seal 84, which seals bracket 68 to deck plate 26 to prevent the omission of any gases which may infiltrate the spaces between bracket 68 and extrusion 32.

As will be appreciated, compressible seals 44, 66, 82 and 84 are provided along all interfaces between adjacent panels and between panels and supporting sides and end walls, so that the cover panel system, once fully installed, provides a completely airtight cover system over the opening to be covered. Although not vital to the invention, it is desirable to cover the gap between adjacent panels above compressible seals 44. By doing so, a more-or-less continuously smooth top surface is provided along a run of panels, which can function as a walkway over the opening. In addition, dirt and other potentially damaging materials are prevented from reaching seal 44 from above. To that end, extrusions 32 and 34 may be provided with a recess 86 in horizontal upper portions 36 for receiving a snap cap 88. Preferably, snap cap 88 is made of an aluminum extrusion, but can be any material suitable for its intended use. As best seen in FIGS.

8 and 9, snap cap 88 is provided with a pair of resilient tabs 90 which are configured to snap into recess 86, which is provided with a pair of detents 92 for retaining snap cap 88 in place. Preferably, one of the snap caps 88 has a rabbet 94 to enable a portion 96 of an adjacent snap cap to fit flush therein. Alternatively, a single snap cap spanning both adjacent panels can be provided.

In order to assist in interlocking adjacent panels together, either male panels 14M or female panels 14F may be provided with a plurality of tabs 98 fastened to the underside of horizontal bottom portion 40 of extrusions 32 or 34. In FIG. 8, a tab 98 is shown as attached, such as by welding, to a female panel 14F. Tab 98 extends horizontally away from panel 14F for a distance sufficient to extend slightly beyond bottom portion 40 of an adjacent panel. The free end of tab 98 extending beyond the bottom portion 40 of an adjacent panel is provided with an upturned flange 100. The gap 102 between bottom portion 40 and upturned flange portion 100 is sufficient to permit normal movement of panels 14F and 14M relative to each other, such as movement caused by expansion and contraction, but upturned flange portion 100 prevents panels 14F and 14M from separating so far as to allow compressible seal 44 to relax and permit the escape of gases between panels 14F and 14M.

To install a cover panel system according to the invention, the required threaded rods 58 and 76 are provided around the sides and ends of the opening, and then panels 14M and 14F are installed alternately across the opening until the entire opening is covered. Preferably, each run of panels begins and ends with a modified female panel in which one end has a "female" extrusion 34, such as shown in FIG. 8, and the opposite end has a "male" extrusion 32, such as shown in FIG. 6, which is fastened to channel end wall 24. Although this is the preferred configuration, the invention is not so limited, and whether or not a run begins with a male or female panel is not critical to the present invention. A run of panels can begin with either a male or female panel, and can end with either a male or female panel, as desired. In addition, if desired, the panels can be fabricated to fit a given opening, so that an integral number of panels in a run precisely fits the opening to be covered. Alternatively, the end panels in a run may substantially overlap the end walls without departing from the scope of the invention.

In any event, in order to install a cover using the cover panel system of the invention, either a modified female, male or female panel is chosen for the first panel in the run and put in place. Then, an alternating sequence of male and female panels (or female and male panels, depending on the type of panel which begins the run) is installed until the run is completed.

If it is necessary to remove a portion of the cover panel system in order to obtain access to the covered vessel, a male panel 14M in a suitable location can be removed without disturbing adjacent panels simply by removing fastening nuts 60 on the ends of the panel and lifting it out. Since the compressible seals 44 are retained in the adjacent female panels, any male panel can easily be removed without disturbing the adjacent female panels. If it is necessary to remove a female panel to obtain access to the opening, it is necessary only to remove the female panel and the two adjacent male panels.

Figure 11:
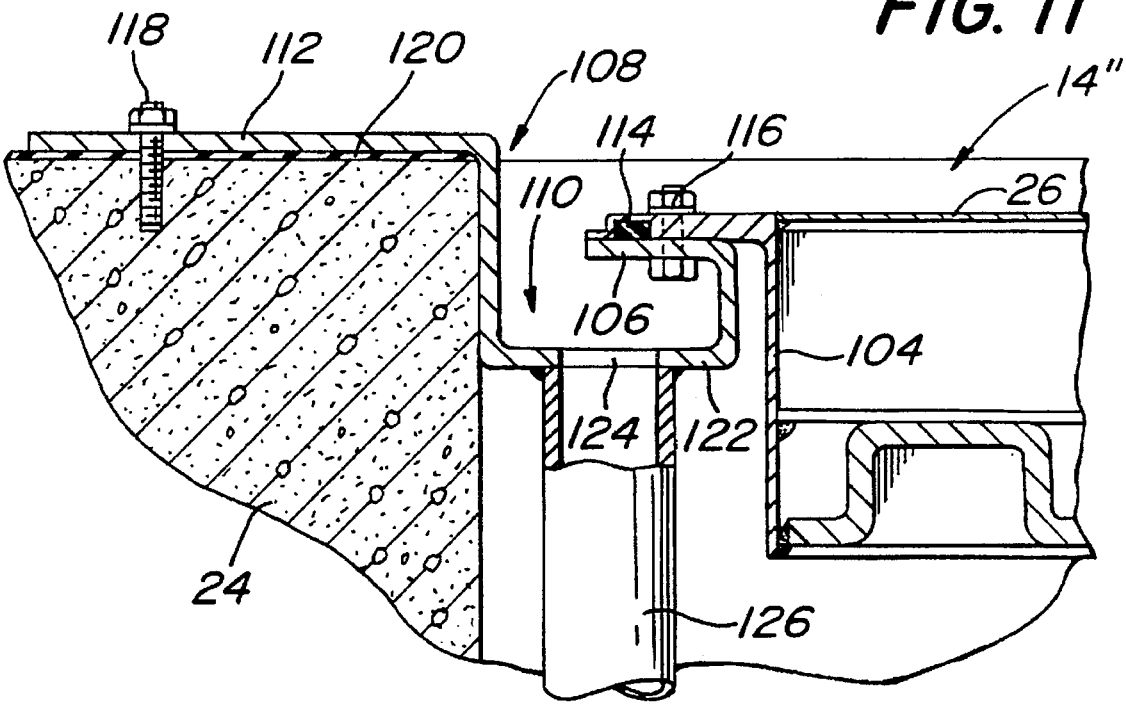
FIG. 11 is a partial sectional view of an alternate method of securing panels to a structure.

In addition to mounting the panels over the channel, as shown in FIGS. 1 through 10, the panels may be mounted in "drop-in" fashion as shown in FIG. 11. FIG. 11 also illustrates the provision of a drainage channel along the edges of the panel cover system of the invention, to accommodate rainwater, runoff, spillover, and the like. In FIG. 11, a panel 14" is illustrated mounted in the "drop-in" configuration. Panel 14" is generally identical to panels 14 and 14', except that instead of having a Z-shaped bracket 68 for mounting the panel to end wall 24, panel 14" is provided with an inverted L-shaped bracket 104, which is welded to deck plate 26 and the extrusions 32 and 34 as in panels 14 and 14'. L-shaped bracket 104 overlies a horizontal wall 106 of a channel extrusion 108, which defines a drainage channel 110 and has a second horizontal wall 112 which overlies the top surface of end wall 24.

The portion of L-shaped bracket 104 which overlies wall 106 if provided with a recess for receiving a resilient seal 114, which is similar to seal 82 discussed previously in connection with the Z-shaped bracket 68. That portion of L-shaped bracket 104 is also provided with an opening which registers with a corresponding opening in wall 106, through which a fastener 116, such as a threaded bolt, may be passed to fasten panel 14" to extrusion 108. In similar manner, wall 112 is provided with an opening through which a fastener 118, such as a bolt, may be passed to fasten extrusion 108 to end wall 24. To help seal extrusion 108 to end wall 24, a resilient seal 120, in the form of a flat sheet, is provided between wall 112 and the top surface of end wall 24.

The bottom wall 122 of extrusion 108 is provided with at least one drain opening 124, through which water or other liquids can drain from channel 110 into the vessel being covered. If desired, a drain line including a trap, such as drain line 126, may be provided to carry drain water into the vessel and prevent backflow of gases.

Preferably, deck plates 26 are made of aluminum alloy 5052, H36 or H32, and the extrusions 32 and 34 are made of ASTM B209 aluminum alloy 6061-T6. Seals 44, 66, 82 and 84 are preferably made of MIL-R-900 neoprene, heavy industrial application EPDM, or other suitable material for severe service environments. Fasteners, such as nuts 60 and 78 and lockwashers 62 and 80, are type 316 stainless steel in compliance with ASTM A167. In addition, deck plates 26 and brackets 54 and 68 are protected from dissimilar materials by use of washers and approved plastic liners, as necessary. Further, it is preferred that all aluminum surfaces in contact with dissimilar material such as concrete, masonry, steel, and non-ferrous metals be coated with zinc chromate paint. It is further preferred that all aluminum be anodized etched with architectural class 1 anodized finish, both sides, A-M12C22A41, clear, as specified by the Aluminum Association.

Figure 12:
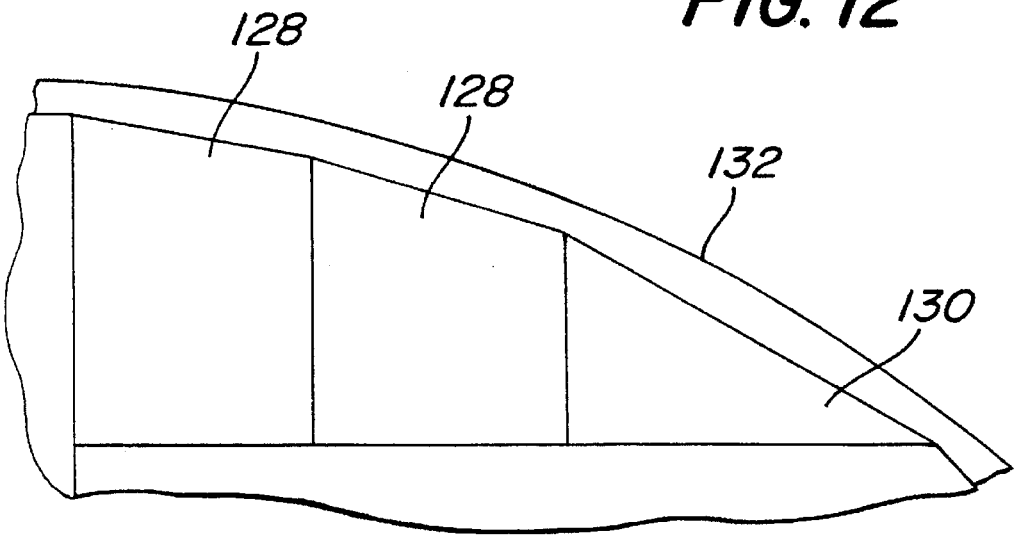
FIG. 12 is a partial plan view showing alternate shapes of panels according to the invention, for covering non-rectangular openings.

Although the individual panels of the present invention have, for convenience, been described as being rectangular in shape, they need not be so limited. They may, for example, have other suitable shapes such as a trapezoid 128 or a triangle 130, as shown in FIG. 12, which enables the panels according to the invention to more easily cover circular openings or other non-rectangular openings. Thus, as shown in FIG. 12, one side of each panel 128 and 130 forms a chord of a circular opening such as in a cylindrical storage tank 132.

It will be appreciated that the present invention offers a number of unique features not available with other cover systems. Due to its modular design, the present invention fits both existing and newly designed structures. No heavy equipment, rigging of special structures, or scaffolding is required for either installation, service, or removal of covers. The invention provides easy access for serviceability. A single panel can be removed without the need to remove more than the adjacent panels.

The easy removability of panels allows for inspection and service of equipment at any point below the cover.

The panels can be modified to allow for removal or relocation of existing equipment, piping or gates. Panels may be fitted with inspection hatches, viewports, vents or any other required auxiliary openings.

The covers do not require caulking to seal and reseal joints.

Only four end retaining nuts need to be removed and reinstalled each time panels are removed or replaced.

No support structures remain in the way of clear access to the vessel below when panels are removed.

The panels accommodate contraction and expansion of covers as well as contraction and expansion of the surrounding structure.

By effectively containing vapors, gases, fumes, and pollutants at the source, the invention provides the following advantages over existing structures: (1) reduced exposure of plant personnel to plant environment; (2) reduced costs for fans, air circulators, and scrubbers; and (3) greater general access to heavy equipment and overhead rigging in case of major equipment failure.

As those skilled in the art will appreciate, for large openings it may be necessary to include an intermediate support system, such as a beam or a truss support system, to aid in supporting the panels of the present invention. Where such intermediate support systems are used, it is a straightforward matter to adapt the panels to rest on and be supported by the intermediate support system in addition to the edges of the opening.

The present invention may be embodied in other specific forms without departing from the spirit or essential attributes thereof and, accordingly, reference should be made to the appended claims, rather than to the foregoing specification, as indicating the scope of the invention.

I claim:

1. A cover panel system for a vessel having an opening, comprising a plurality of individual panels arranged side-by-side and spanning at least a portion of said opening, said panels being of a first type and a second type and arranged in an alternating sequence of first type and second type panels, each panel having four sides and having depending end walls and depending side walls at angles to the end walls defining a frame and a deck plate supported on and attached to the frame, the end walls of each panel including an outwardly extending flange for supporting the panel at its respective end walls across said portion of said opening, the side portions of adjacent panels facing each other and defining a gap therebetween, a compressible seal non-permanently attached to each side wall of one of the first and second types of panels on an outwardly facing surface of the side wall in the gap between the side walls of adjacent panels for tightly sealing the facing side portions of adjacent panels, and at least one tab extending outwardly from a bottom portion of each side of one of the first and second type panels for engaging and removably interlocking adjacent panels together.

2. A cover panel system according to claim 1, wherein the first type panel includes said outwardly extending tabs on both side walls thereof and the second type panel does not include tabs.

3. A cover panel system according to claim 1, further comprising a third type panel having said outwardly extending tabs on only one side wall thereof.

4. A cover panel system according to claim 3, wherein the alternating sequence of panels terminates at each end in a third type panel.

5. A cover panel system according to claim 1, wherein the four sides of the panel defines a rectangle.

6. A cover panel system according to claim 1, wherein the four sides of the panel defines a trapezoid.

7. A cover panel system according to claim 1, further comprising removable caps attached to at least one of a pair of adjacent panels for closing the gap between the side walls of the adjacent panels above the compressible seal.

8. A cover panel system according to claim 1, further comprising each panel being supported along said depending end walls by a support member having a panel support surface and defining a drainage channel therein.

9. A cover panel system according to claim 1, wherein each panel is supported along said depending end walls by sides of said opening.

10. A cover panel system according to claim 8, further comprising seal means for sealing said end walls to said support member panel support surface.

11. A cover panel system according to claim 9, further comprising means for sealing said end walls to said sides of said opening.

12. A cover panel system for a vessel having an opening, comprising a plurality of individual panels arranged adjacent each other and spanning at least a portion of said opening, each panel being generally polygonal in shape and having a depending side wall depending from each polygon side, each panel being supported along at least one depending side wall across said portion of said opening, the side walls of adjacent panels facing each other and defining a gap therebetween;

a compressible seal disposed in the gap between the side walls of adjacent panels for tightly sealing the facing side walls of adjacent panels, said compressible seal being carried by a side wall of one of two adjacent panels;

means for removably interlocking adjacent panels together; and removable caps attached to at least one of a pair of adjacent panels for closing the gap between the side walls of the adjacent panels above the compressible seal.

* * * * *